US011205396B2

(12) United States Patent
Zheng et al.

(10) Patent No.: US 11,205,396 B2
(45) Date of Patent: Dec. 21, 2021

(54) DISPLAY PANEL, METHOD FOR DRIVING DISPLAY PANEL, AND DISPLAY DEVICE

(71) Applicant: Xiamen Tianma Micro-Electronics Co., Ltd., Xiamen (CN)

(72) Inventors: Zhiwei Zheng, Xiamen (CN); Zhijie Wang, Xiamen (CN); Jiaqian Wu, Xiamen (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 0 days.

(21) Appl. No.: 16/706,801

(22) Filed: Dec. 8, 2019

(65) Prior Publication Data

US 2020/0111431 A1 Apr. 9, 2020

(30) Foreign Application Priority Data

Jun. 18, 2019 (CN) ..... 201910525336.2

(51) Int. Cl.
*G09G 3/36* (2006.01)

(52) U.S. Cl.
CPC ..... *G09G 3/3614* (2013.01); *G09G 3/3607* (2013.01); *G09G 2310/0297* (2013.01); *G09G 2320/0209* (2013.01); *G09G 2320/0247* (2013.01)

(58) Field of Classification Search
CPC ..... G09G 3/3614; G09G 3/3607; G09G 2310/0297
See application file for complete search history.

(56) References Cited

U.S. PATENT DOCUMENTS 7,259,755 B1 * 8/2007 Ahn ..... G09G 3/3614 345/204
2004/0109122 A1 * 6/2004 Kumagawa ..... G02F 1/134363 349/143
2004/0246404 A1 * 12/2004 Elliott ..... G09G 3/3648 349/88
2008/0204434 A1 * 8/2008 Lee ..... G02F 1/1345 345/205
2010/0013864 A1 * 1/2010 Oelhafen ..... G09G 3/3688 345/690
2015/0009112 A1 * 1/2015 Okumoto ..... G09G 3/3614 345/96

(Continued)

FOREIGN PATENT DOCUMENTS

CN 101317212 A 12/2003
CN 101937142 A 1/2011

(Continued)

*Primary Examiner* — Vinh T Lam
(74) *Attorney, Agent, or Firm* — Kilpatrick Townsend & Stockton, LLP

(57) ABSTRACT

The present disclosure provides a display panel, a method for driving the display panel, and a display device. In embodiments of the present disclosure, the display panel includes a display area, where pixels arranged in an array are arranged in the display area, each pixel includes a plurality of sub-pixels, and at least some sub-pixels among the sub-pixels included in each pixel have different colors. The driving method includes: driving, polarities of display signals inputted to some sub-pixels among the sub-pixels having the same color in at least one row of sub-pixels to be different.

14 Claims, 10 Drawing Sheets

(56) References Cited

U.S. PATENT DOCUMENTS

| | | | | |
|---|---|---|---|---|
| 2015/0138464 | A1* | 5/2015 | Okazaki | G09G 3/3614 349/37 |
| 2016/0055808 | A1* | 2/2016 | Guo | G09G 3/3208 345/694 |
| 2016/0260394 | A1* | 9/2016 | Oh | G09G 3/3696 |
| 2016/0314736 | A1* | 10/2016 | Sang | G09G 3/3648 |
| 2017/0169776 | A1* | 6/2017 | Hwang | G09G 3/3614 |
| 2017/0343867 | A1* | 11/2017 | Su | G09G 3/3607 |
| 2018/0204531 | A1* | 7/2018 | Su | G09G 3/3614 |
| 2018/0261180 | A1* | 9/2018 | Zhou | G09G 3/3688 |
| 2019/0019465 | A1* | 1/2019 | Nojiri | G02B 30/30 |
| 2020/0089067 | A1* | 3/2020 | Song | G02F 1/136286 |
| 2020/0118511 | A1* | 4/2020 | Chen | G09G 3/3648 |
| 2021/0082359 | A1* | 3/2021 | Ji | G09G 3/20 |
| 2021/0142755 | A1* | 5/2021 | Yang | G09G 3/3611 |
| 2021/0166643 | A1* | 6/2021 | He | G09G 3/3607 |
| 2021/0210042 | A1* | 7/2021 | Liu | G09G 3/3696 |

FOREIGN PATENT DOCUMENTS

| | | | |
|---|---|---|---|
| CN | 103901685 | A | 7/2014 |
| CN | 104898317 | A | 9/2015 |
| CN | 103280195 | B | 1/2016 |
| CN | 108648708 | A | 10/2018 |
| CN | 108877730 | A | 11/2018 |
| WO | 2015056444 | A1 | 4/2015 |

* cited by examiner

DISPLAY PANEL, METHOD FOR DRIVING DISPLAY PANEL, AND DISPLAY DEVICE

CROSS REFERENCES

This application claims priority to Chinese Patent Application No. 201910525336.2, filed on Jun. 18, 2019, which is hereby incorporated by reference in its entirety.

FIELD

The present disclosure relates to the field of display, in particular, to a display panel, a method for driving the display panel, and a display device.

BACKGROUND

A liquid crystal display is a non-self-luminous display, and needs to be provided with a backlight module, and a display function is implemented by a backlight source provided by the backlight module. The liquid crystal display includes: a liquid crystal, and a pixel electrode and a common electrode for driving the liquid crystal to be deflected.

SUMMARY

Embodiments of the present disclosure provide a display panel, a method for driving the display panel, and a display device.

In one embodiment of the present disclosure provides a display panel. The display panel includes a display area, the display area includes a plurality of pixels arranged in an array, each pixel includes a plurality of sub-pixels, and at least some sub-pixels among the plurality of sub-pixels included in each pixel have different colors. In at least one row of the plurality of sub-pixels, polarities of display signals inputted to some sub-pixels among the sub-pixels having the same color are different.

In another embodiment of the present disclosure provides a method for driving a display panel. The method includes driving, polarities of display signals inputted to some sub-pixels among the sub-pixels having the same color in at least one row of the plurality of sub-pixels, to be different.

In yet another embodiment of the present disclosure provides a display device, including the display panel provided by the embodiment of the present disclosure.

BRIEF DESCRIPTION OF THE DRAWINGS

In order to describe the embodiments of the present disclosure more clearly, the drawings illustrated in the embodiments of the present disclosure will be briefly described below. It is apparent that the following drawings are only some embodiments of the present disclosure.

DETAILED DESCRIPTION OF THE EMBODIMENTS

Some embodiments of a display panel, a method for driving the display panel, and a display device provided by the present disclosure are described in details below in conjunction with the accompanying drawings. It shall be noted that the described embodiments are only some embodiments of the present disclosure, and not all of the embodiments.

Figure 1:
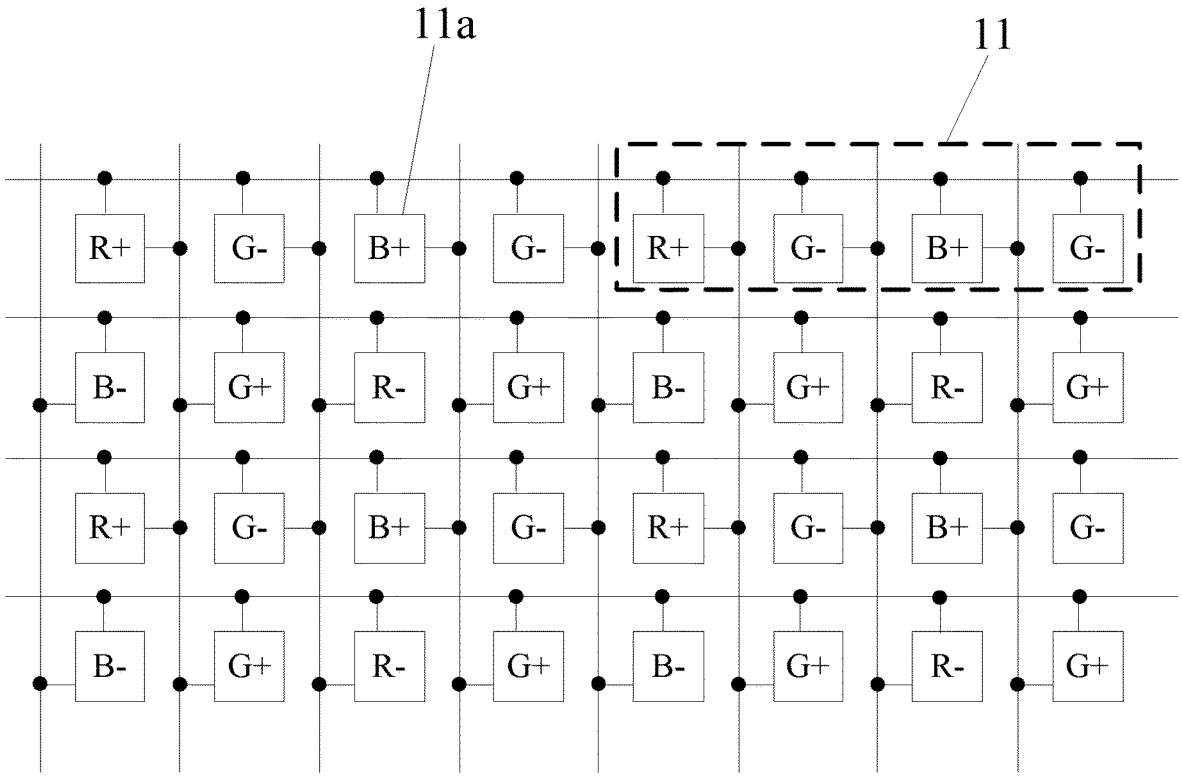
FIG. 1 illustrates a schematic diagram of the situation that polarities of display signals inputted to sub-pixels having the same color in each row of sub-pixels are the same in the related art.

FIG. 1 illustrates a schematic diagram of the situation that polarities of display signals inputted to sub-pixels having the same color in each row of sub-pixels are the same. A display panel may include a plurality of pixels 11 arranged in an array. Each pixel 11 may include four sub-pixels 11*a*, for example, one red sub-pixel, two green sub-pixels and one blue sub-pixel. The sub-pixels 11*a* are arranged as shown in FIG. 1.

Figure 2:
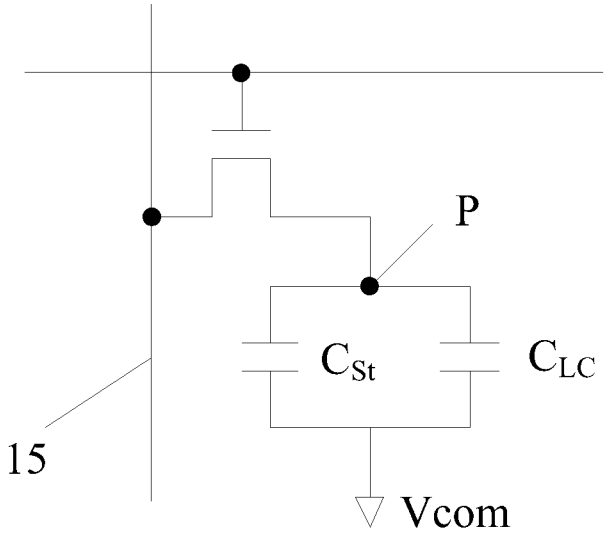
FIG. 2 illustrates an equivalent circuit diagram of respective structure in a sub-pixel in the related art.

FIG. 2 illustrates an equivalent circuit diagram of respective structure in a sub-pixel in the display panel. As shown in FIG. 2, a data line 15 is electrically connected to a pixel electrode (the pixel electrode is indicated by a black dot labeled P) by a transistor. Capacitors between the pixel electrode P and a common electrode (indicated by Vcom) include: a liquid crystal capacitor indicated by $C_{LC}$ and a storage capacitor indicated by Cst. When a sudden change in the polarity of a display signal on the data line 15 occurs, a sudden change in a signal of the pixel electrode P also occurs. When a voltage difference between capacitors (i.e. $C_{LC}$ and Cst) remains unchanged, a common signal on the common electrode is affected. For a row of sub-pixels, if there is the same effect on common signals, this effect will be amplified, so that the common signals are pulled up or down.

It should be noted that the common electrode mentioned in the embodiments of the present disclosure may be understood as follows.

The display panel may include a plurality of block electrodes arranged in an array, and each block electrode is defined as a common electrode. The common electrode may be reused as a touch electrode, so that a touch function may be implemented.

In one embodiment, the display panel may include a plurality of strip electrodes, and each strip electrode is defined as a common electrode. The common electrode may be reused as a touch electrode, so that a touch function may be implemented.

Further, the shape of the common electrode is not limited to the above-described block shape or strip shape, or may be other shapes. This is not limited herein.

For example, FIG. 1 illustrates the polarities of display signals inputted to all sub-pixels 11*a* when some frame of picture is displayed. By taking the second row of sub-pixels as an example, the polarity of a display signal inputted to each red sub-pixel R is negative (indicated by '−' as illustrated in FIG. 1). When a next frame of picture is displayed, the polarity of the display signal inputted to each red sub-pixel R in the second row of sub-pixels is positive, to ensure an effective display function.

Thus, a sudden change from low to high in the polarities of the display signals in the red sub-pixels R occurs, and therefore the common signal on the corresponding common electrode is affected. Polarities of display signals inputted to red sub-pixels R in one row of sub-pixels are all the same, that is, change from a negative polarity to a positive polarity, so that effects of the second row of sub-pixels on common signals are the same. As a result, the common signals are entirely pulled up.

Similarly, for the third row of sub-pixels, when a current frame of picture is displayed, the polarity of a display signal inputted to each red sub-pixel R shown in FIG. 1 is positive (indicated by '+' in FIG. 1). However, when a next frame of picture is displayed, the polarity of the display signal inputted to each red sub-pixel R in the third row of sub-pixels is negative, to ensure an effective display function.

Thus, a sudden change from high to low in the polarity of the display signal in the red sub-pixel R occurs, and therefore the common signal on the corresponding common electrode is affected. Polarities of display signals inputted to red sub-pixels R in one row of sub-pixels are all the same, that is, change from a positive polarity to a negative polarity, so that effects of the third row of sub-pixels on common signals are the same. As a result, the common signals are entirely pulled down.

Due to the change of the polarity of the display signal, the common signals in the common electrodes corresponding to each row of sub-pixels are disturbed by the polarities of the display signals, and the disturbance is from one direction, so that crosstalk and flicker in a horizontal direction are formed. Especially, the crosstalk and flicker are severer when a single picture is displayed (such as, but not limited to, a red picture). Consequently, the display effect becomes poor.

In view of the above, an embodiment of the present disclosure provides a method for driving the display panel, to improve crosstalk and flicker in a horizontal direction that occur during a display process, to improve the display effect.

Figure 4:
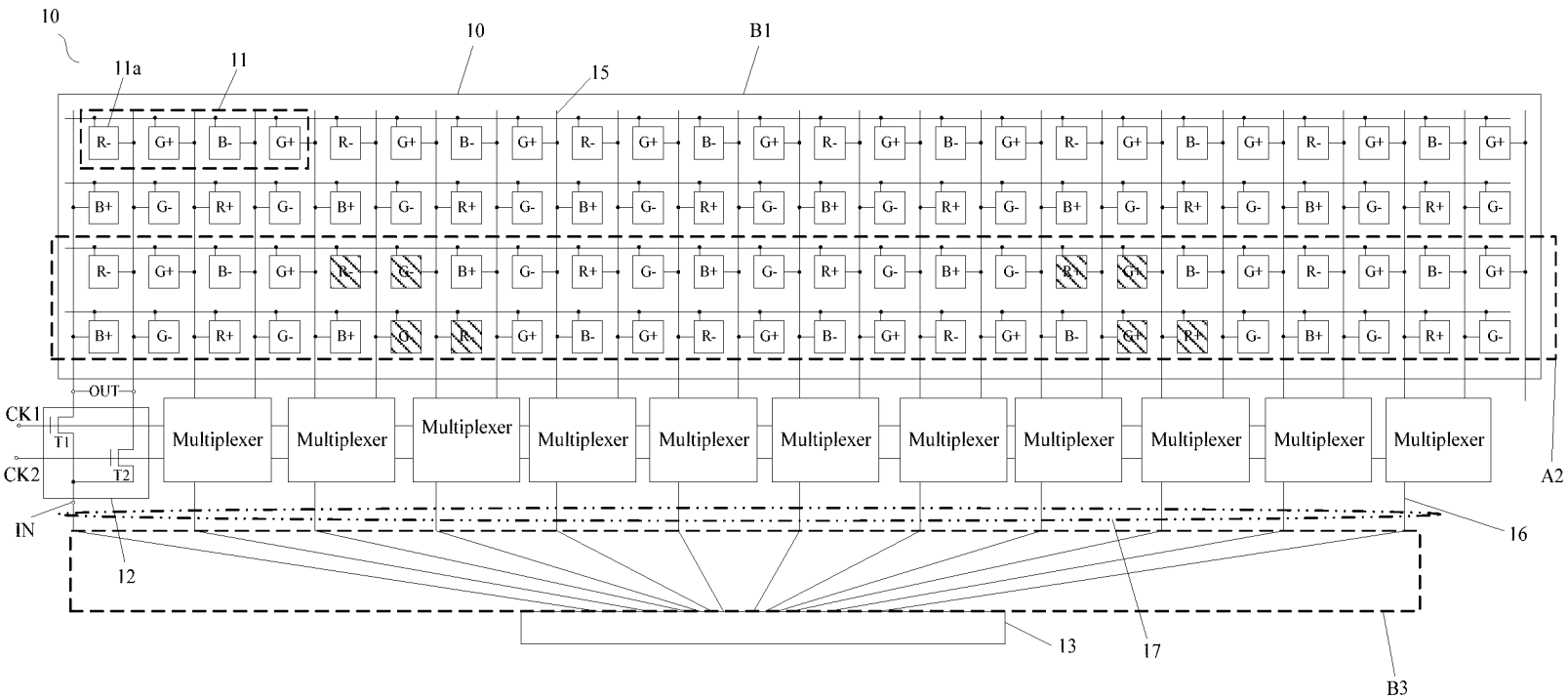
FIG. 4 illustrates a structural schematic diagram of a display panel in which a first type of multiplexer is disposed according to an embodiment of the present disclosure.
Figure 5:
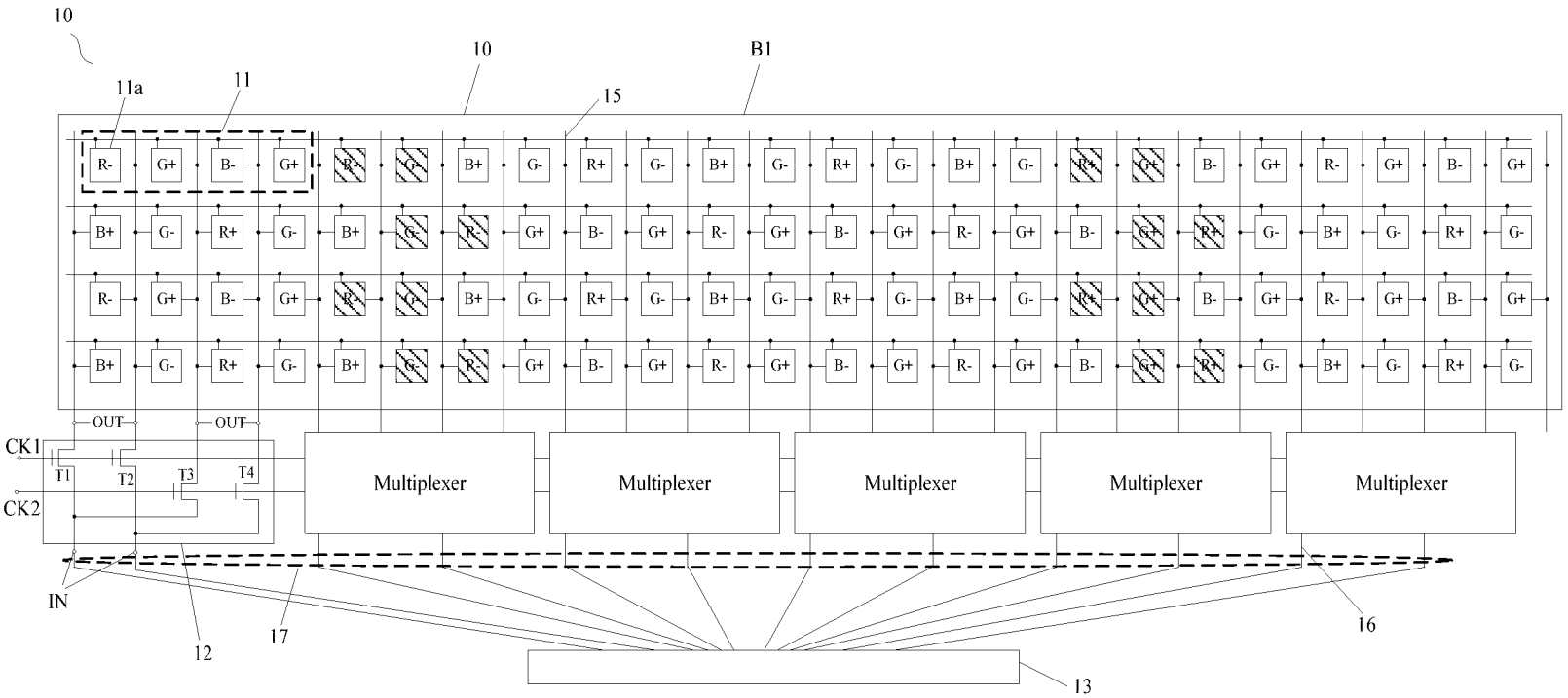
FIG. 5 illustrates a structural schematic diagram of a display panel in which a second type of multiplexer is disposed according to an embodiment of the present disclosure.
Figure 6:
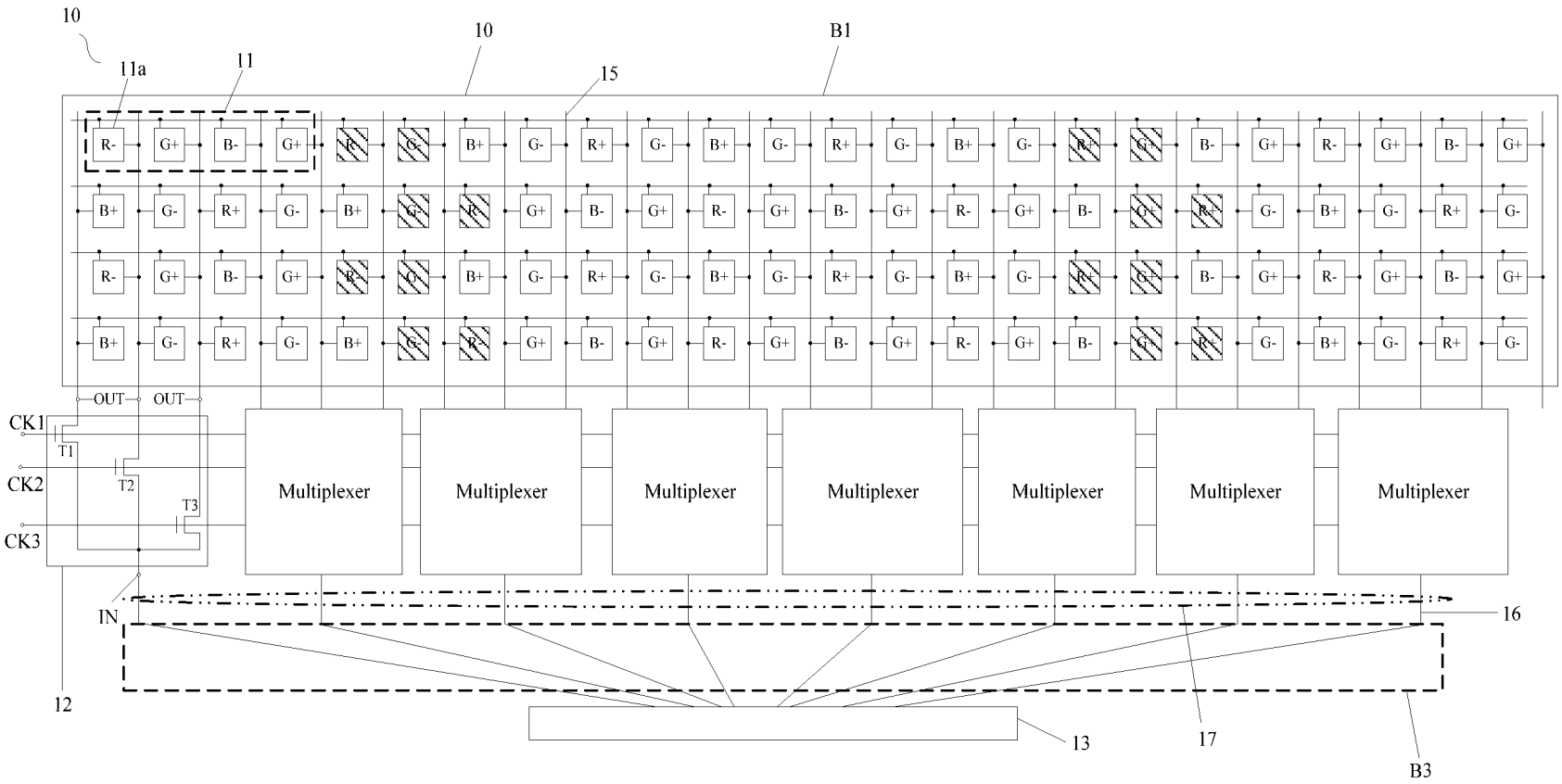
FIG. 6 illustrates a structural schematic diagram of a display panel in which a third type of multiplexer is disposed according to an embodiment of the present disclosure.
Figure 7:
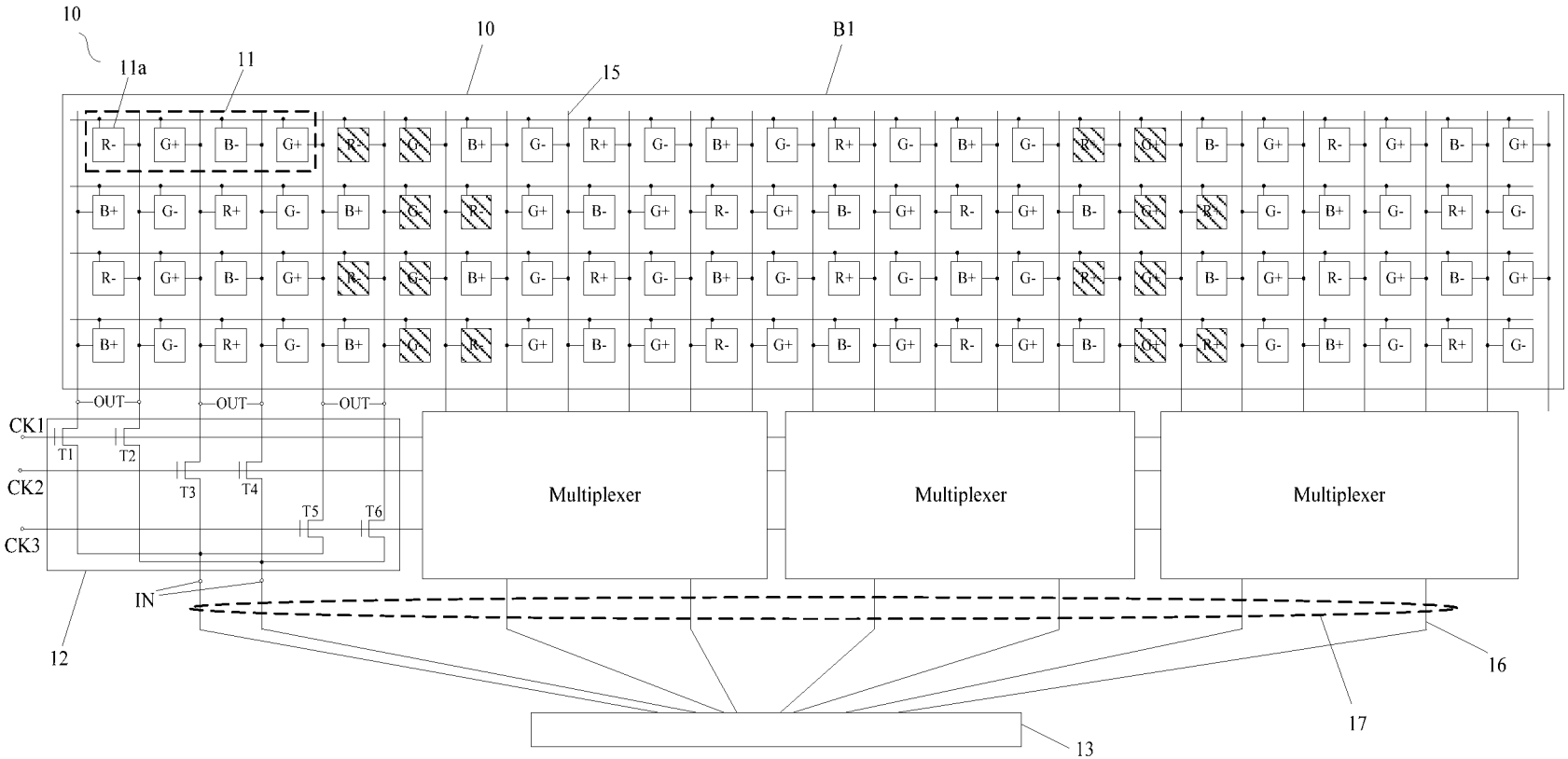
FIG. 7 illustrates a structural schematic diagram of a display panel in which a fourth type of multiplexer is disposed according to an embodiment of the present disclosure.
Figure 8:
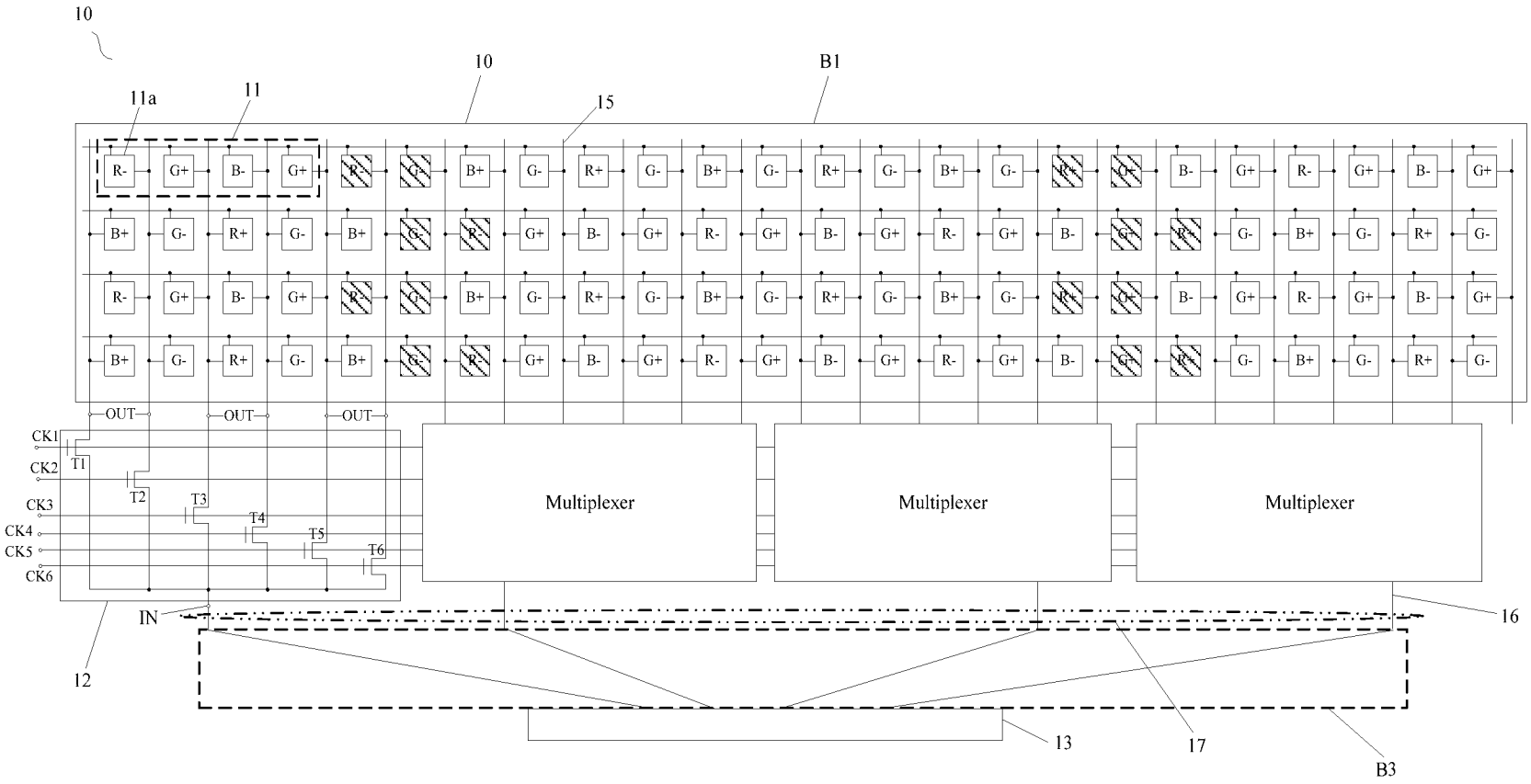
FIG. 8 illustrates a structural schematic diagram of a display panel in which a fifth type of multiplexer is disposed according to an embodiment of the present disclosure.
Figure 9:
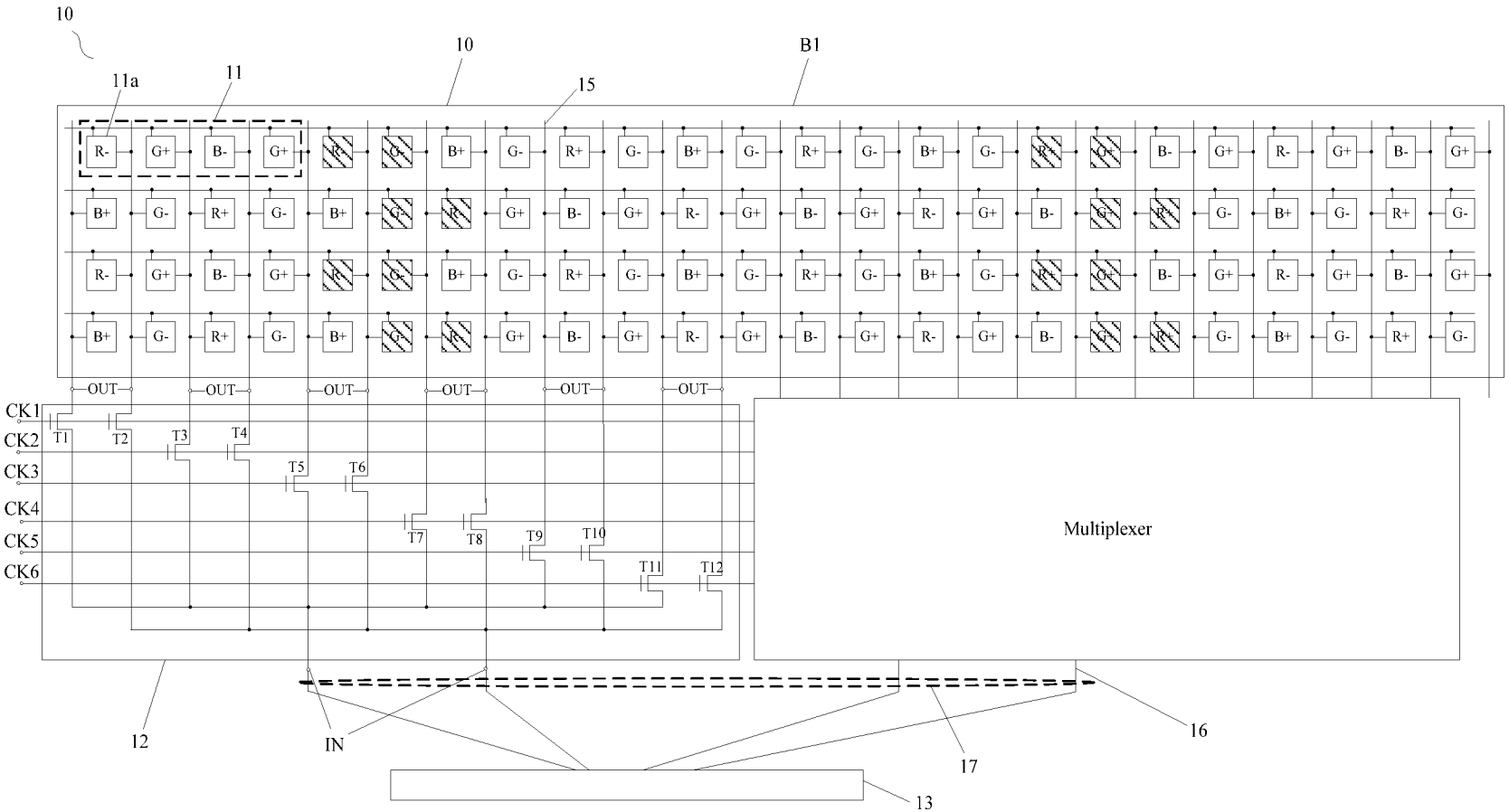
FIG. 9 illustrates a structural schematic diagram of a display panel in which a sixth type of multiplexer is disposed according to an embodiment of the present disclosure.

Before describing the method for driving the display panel provided by the embodiments of the present disclosure, a structure of the display panel is first described. As shown in FIG. 3 to FIG. 9, FIG. 3 illustrates a structural schematic diagram of a display panel in which a multiplexer is not disposed. FIG. 4 illustrates a structural schematic diagram of a display panel in which a first type of multiplexer is disposed. FIG. 5 illustrates a structural schematic diagram of a display panel in which a second type of multiplexer is disposed. FIG. 6 illustrates a structural schematic diagram of a display panel in which a third type of multiplexer is disposed. FIG. 7 illustrates a structural schematic diagram of a display panel in which a fourth type of multiplexer is disposed. FIG. 8 illustrates a structural schematic diagram of a display panel in which a fifth type of multiplexer is disposed. FIG. 9 illustrates a structural schematic diagram of a display panel in which a sixth type of multiplexer is disposed.

Referring to FIG. 3 to FIG. 9, a display panel 10 may include a display area B1. Pixels 11 arranged in an array are arranged in the display area B1. Each pixel 11 includes a plurality of sub-pixels 11*a*. At least some sub-pixels 11*a* among the plurality of sub-pixels 11*a* included in each pixel have different colors.

The method for driving the display panel provided by the embodiments of the present disclosure may include driving, polarities of display signals inputted to some sub-pixels among the sub-pixels having the same color in at least one row of sub-pixels, to be different.

In the embodiments of the present disclosure, in the at least one row of sub-pixels, the polarities of the display signals inputted to some sub-pixels among the sub-pixels having the same color are different, so that for the sub-pixel row in which the polarities of the display signals inputted to some sub-pixels in the sub-pixels having the same color are different, when two consecutive frame of pictures are displayed, the polarities of the display signals inputted to the sub-pixels having the same color in the sub-pixel rows do not all suddenly change from low to high or from high to low. Instead, some polarities change from low to high, and some polarities change from high to low. In this way, common signals in common electrodes corresponding to these sub-pixel rows are disturbed in different directions (where pull-up and pull-down are in different directions), so that cancellation is formed. Crosstalk and flicker in a horizontal direction that are brought when the polarities of the display signals inputted to the sub-pixels having the same color are the same may be cancelled out, to thereby improve the display effect of the display panel.

It shall be noted that, when each pixel includes four sub-pixels, the polarities of the display signals inputted to the sub-pixels having the same color in one row of sub-pixels may be the same. Consequently, a problem of crosstalk and flicker in a horizontal direction may occur. When each pixel includes three sub-pixels, for a dot inversion driving manner, the polarities of the display signals inputted to the sub-pixels having the same color in one row of sub-pixels are not the same. Therefore, the problem of crosstalk and flicker in a horizontal direction may not occur.

Therefore, in the embodiments of the present disclosure, each pixel may include four sub-pixels.

In one embodiment, each pixel may include one red sub-pixel, two green sub-pixels and one blue sub-pixel. In one embodiment, referring to arrangement of the sub-pixels 11*a* included in each pixel as shown in FIGS. 3 to 9. In one embodiment, each pixel includes one red sub-pixel, one green sub-pixel, one blue sub-pixel and one white sub-pixel. This is not shown in the figures.

In some embodiments, colors of four sub-pixels 11*a* included in each pixel may be any other colors that may implement a display function.

Figure 3:
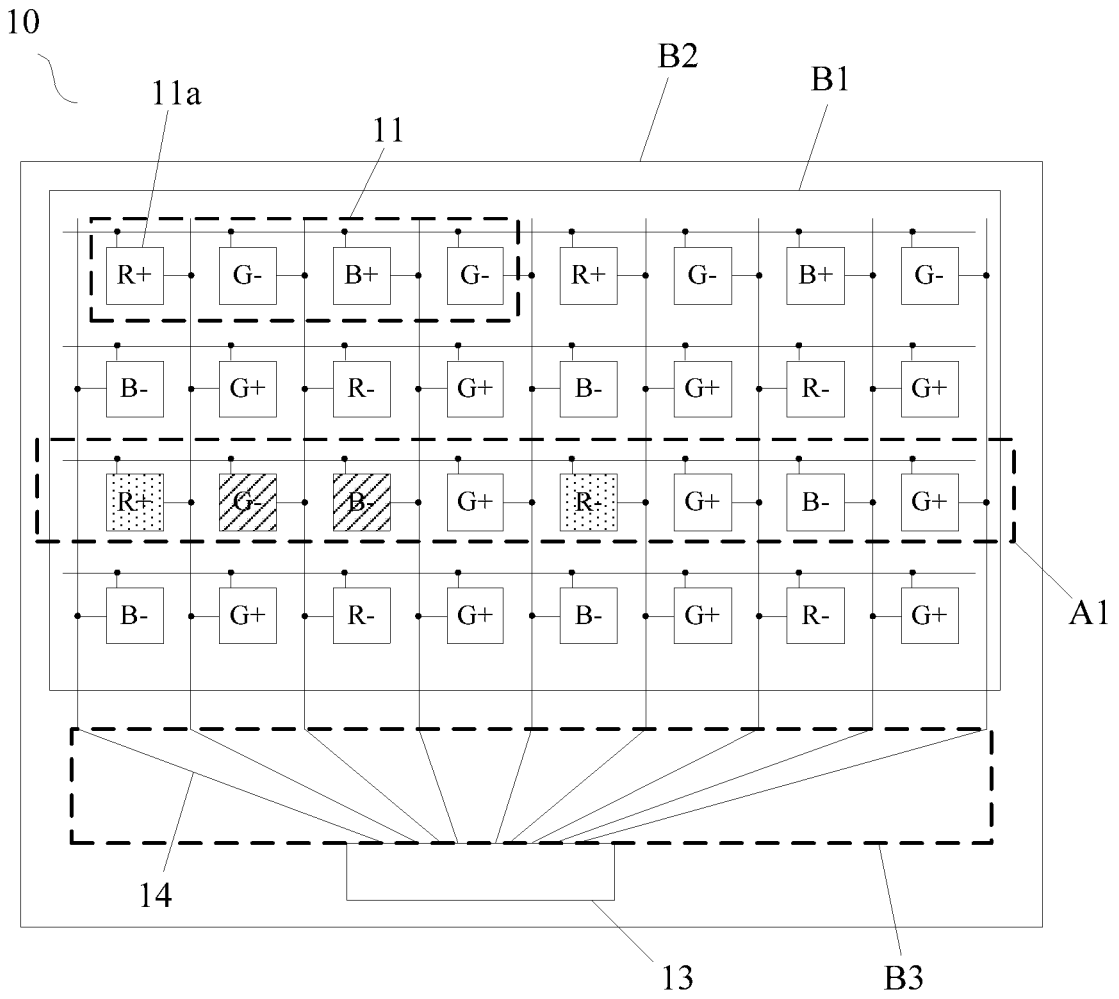
FIG. 3 illustrates a structural schematic diagram of a display panel in which a multiplexer is not disposed according to an embodiment of the present disclosure.

In one embodiment, in the embodiments of the present disclosure, there may be only one row of sub-pixels in which polarities of display signals inputted to some sub-pixels among the sub-pixels having the same color are different, for example, one row of sub-pixels as shown in a broken line box A1 in FIG. 3. Polarities of display signals inputted to two red sub-pixels R indicated by regions filled with sparse black dots are different, that is, one is a positive polarity and indicated by '+', the other is a negative polarity and indicated by '−'.

In one embodiment, in only some rows of sub-pixels of all rows of sub-pixels, polarities of display signals inputted to some sub-pixels among the sub-pixels having the same color are different. For example, as shown in FIG. 4, there are four rows of sub-pixels shown in FIG. 4. Polarities of display signals inputted to some sub-pixels among the sub-pixels having the same color in two rows of sub-pixels are different, such as the two rows of sub-pixels shown in a broken line box A2. Polarities of display signals inputted to some sub-pixels among the sub-pixels having the same color in the other two rows of sub-pixels are the same.

In this way, crosstalk and flicker in a horizontal direction that are brought when the polarities of the display signals inputted to the sub-pixels having the same color are the same may be cancelled out to a certain extent.

Certainly, in the embodiments of the present disclosure, it may be further set that polarities of display signals inputted to some sub-pixels among the sub-pixels having the same color in any row of sub-pixels are different, as shown in FIG. 5 to FIG. 9. That is, polarities of display signals inputted to some sub-pixels among the sub-pixels having the same color in each row of sub-pixels are different.

In this way, crosstalk and flicker in a horizontal direction that are brought when caused the polarities of the display signals inputted to the sub-pixels having the same color are the same may be cancelled out to a greatest extent, so that the display effect of the display panel is effectively improved.

In one embodiment, in the embodiments of the present disclosure, for a sub-pixel row in which polarities of display signals inputted to some sub-pixels among the sub-pixels having the same color are different: if the sub-pixels having the same color include a first sub-pixel and a second sub-pixel, when a display signal having a positive polarity is inputted to the first sub-pixel, a display signal having a negative polarity is inputted to the second sub-pixel, among common electrodes corresponding to the same row of sub-pixels, common signals in some common electrodes are pulled up, and common signals in some other common electrodes are pulled down. If the number of first sub-pixels is different from the number of second sub-pixels, common signals in the common electrodes corresponding to the same row of sub-pixels may be prevented from being entirely pulled up or pulled down, so that changes in the common signals in some common electrodes are decreased, to thereby reduce crosstalk and flicker in a horizontal direction.

In one embodiment, referring to a green sub-pixel G in a broken line box A1 in FIG. 3, four green sub-pixels G are shown in the broken line box A1. The polarity of a display signal inputted to one green sub-pixel G in an oblique line filled area is negative, which is indicated by '−', and polarities of display signals inputted to the other three green sub-pixels G are all positive, which are indicated by '+'. If the green sub-pixel G in the oblique line filled area is recorded as a second sub-pixel, and the other three green sub-pixels G are all recorded as first sub-pixels, the number of first sub-pixels is three, and the number of second sub-pixels is one, that is, the number of first sub-pixels is greater than the number of second sub-pixels.

Moreover, the number of first sub-pixels and the number of second sub-pixels may be flexibly designed according to needs of different scenarios, so that design flexibility is improved.

In the embodiments of the present disclosure, the number of first sub-pixels may be equal to the number of second sub-pixels, as shown in FIG. 4 to FIG. 9, so that in common electrodes corresponding to the same row of sub-pixels, common signals in half of the common electrodes will be pulled up, and common signals in the other half of the common electrodes will be pulled down. Therefore, changes in the common signals in the common electrodes may be completely canceled, and crosstalk and flicker in a horizontal direction are reduced to a greatest extent, so that the display effect is effectively improved.

In one embodiment, to implement that in at least one row of sub-pixels, polarities of display signals inputted to some sub-pixels among the sub-pixels having the same color are different, in the embodiments of the present disclosure, for a sub-pixel row in which polarities of display signals inputted to some sub-pixels among the sub-pixels having the same color are different: polarities of display signals inputted to some two adjacent sub-pixels may be the same, and polarities of display signals inputted to remaining two adjacent sub-pixels may be different.

For example, as shown in FIG. 3 to FIG. 8, only some sub-pixels are shown in the figure, but this does not mean that only these sub-pixels are included in the actual display panel. In this case, some sub-pixels are only used as an example for description.

Referring to FIG. 3, two sub-pixels in the oblique line filled areas in the broken line box A1 are the green sub-pixel G and a blue sub-pixel B, and polarities of display signals inputted to the green sub-pixel G and the blue sub-pixel B are negative, which are indicated by '-'.

Referring to FIG. 4, oblique line filled areas in the broken line box A2 indicate that polarities of display signals inputted to two adjacent sub-pixels are the same. Four rows of sub-pixels are shown in FIG. 4. In the third row of sub-pixels: polarities of display signals inputted to a red sub-pixel R and a green sub-pixel G on the left side are negative, which are indicated by '−', and polarities of display signals inputted to a red sub-pixel R and a green sub-pixel G on the right side are positive, which are indicated by '+'.

Referring to FIG. 5 to FIG. 9, four rows of sub-pixels are shown in the figure. By taking the first row of sub-pixels as an example, polarities of display signals inputted to a red sub-pixel R and a green sub-pixel G on the left side are negative, which are indicated by '−', and polarities of display signals inputted to a red sub-pixel R and a green sub-pixel G on the right side are positive, which are indicated by '+'.

In this way, the situation that polarities of display signals inputted to the sub-pixels having the same color in the same row of sub-pixels are the same may be effectively avoided, so that the problem of crosstalk and flicker in a horizontal direction is avoided, to thereby improve the display effect of the display panel.

In one embodiment, to implement inputting the display signal into the sub-pixel, in the embodiments of the present disclosure, the display panel may include a plurality of data lines 15, and a column of sub-pixels is disposed between any two adjacent data lines 15. In addition, sub-pixels located in an odd row are electrically connected to the adjacent data line 15 on the right side, and sub-pixels located in an even row are electrically connected to the adjacent data line 15 on the left side.

In one embodiment, referring to FIG. 3 to FIG. 9, four rows of sub-pixels are shown in the figure. The first row of sub-pixels and the third row of sub-pixels are electrically connected to the adjacent data line 15 on the right side. The second row of sub-pixels and the fourth row of pixels are electrically connected to the adjacent data line 15 on the left side.

That is, a column of sub-pixels may be electrically connected to two adjacent data lines 15 on the left and right sides. If polarities of display signals transmitted by at least some two adjacent data lines 15 are opposite, it is possible that polarities of display signals inputted to some two adjacent sub-pixels in a row direction are the same, but polarities of display signals inputted to some other two adjacent sub-pixels are different, so that it is helpful to avoid occurrence of crosstalk and flicker in a horizontal direction, to thereby improve the display effect of the display panel.

It should be noted that, in the embodiments of the present disclosure, the connection manner of the data lines 15 and the sub-pixels is not limited to that shown in FIG. 3 to FIG. 9, a column of sub-pixels may be electrically connected to one data line 15, or another connection manner is set according to actual needs, provided that the display signals may be transmitted to the sub-pixels by using the data lines 15, and it is ensured that polarities of display signals inputted to some sub-pixels among the sub-pixels having the same color in at least one row of sub-pixels are different. The connection manner of the data lines 15 and the sub-pixels is not specifically limited.

In one embodiment, in the embodiments of the present disclosure, the display panel may include a frame area B2 surrounding the display area B1. A driving chip 13 may be disposed in the frame area B2. The data lines 15 may be directly connected to the driving chip 13, as shown in FIG. 3, so that the driving chip 13 may directly inputting display signals to all data lines 15, and the display signals are inputted to the sub-pixels 11*a* by the data lines 15.

It should be noted that, the frame area B2 may include a fan-out area B3, and a plurality of leads 14 are disposed in the fan-out area B3, and the leads 14 are used to connect the data lines 15 or other signal lines in the display area B1 to the driving chip 13 (only some leads 14 are shown in the figure). If the data lines 15 are directly connected to the driving chip 13, a plurality of leads 14 needs to be arranged in the fan-out region B3 to implement electrical connection between the data lines 15 and the driving chip 13. In this way, not only may the area of the fan-out region B3 be increased, but also the display function may be affected due to a short circuit between the leads 14 caused by an excessive number of leads 14 that are arranged.

Therefore, to solve the above problem, in the embodiments of the present disclosure, as shown in FIG. 4 to FIG. 9, where the frame area B2 is not shown in FIG. 4 to FIG. 9, multiplexers 12 and data buses 16 may be disposed in the frame area B2. The outputting ends OUT of the multiplexers 12 are electrically connected to the data lines 15, and the inputting ends IN of the multiplexers 12 are electrically connected to the data buses 16.

In this case, the driving method may further include the following operations.

The multiplexers 12 input, in a time sharing manner, display signals inputted by the data buses 16 into the data lines 15 that are correspondingly connected with the multiplexers 12, and then the display signals are inputted into the sub-pixels via the data lines 15, to enable the polarities of display signals inputted to some sub-pixels among the sub-pixels having the same color in at least one row of sub-pixels to be different.

Thus, the multiplexers 12 are disposed, so that electrical connection between the data lines 15 and the driving chip 13 may be implemented by using the multiplexers 12. The number of the data buses 16 is much smaller than the number of the data lines 15. Therefore, the number of the leads 14 disposed in the fan-out region B3 may be reduced, and probability of occurrence of a short circuit between the leads 14 is reduced, to improve reliability of signal transmission and the display effect.

In some embodiments, there may be various structures of the multiplexers 12. The multiplexers 12 of different structures have different ratios of the number of outputting ends OUT to the number of inputting ends. If F1 indicates the number of outputting ends, and F2 indicates the number of inputting ends, values of F1/F2 are different for the multiplexers 12 of different structures.

In the embodiments of the present disclosure, there are different ratios (F1/F2) of the number of outputting ends OUT of the multiplexer 12 to the number of inputting ends, and the quantities of data buses 16 included in different cycle units are different.

Each cycle unit 17 includes a plurality of data buses 16, and polarity reversal manners of display signals in the data buses 16 in different cycle units 17 are the same.

It should be noted that, the polarity reversal manners of the display signals in the data buses 16 in different cycle units 17 are the same may be understood as follows.

If each cycle unit includes N number of data buses, for two cycle units, for ease of description, first, the two cycle units are respectively defined as a first cycle unit and a second cycle unit herein, the first cycle unit and the second cycle unit each includes N number of data buses, the number of N data buses in the first cycle unit are respectively labeled as X11, X12, . . . , X1*n*, and the number of N data buses in the second cycle unit are respectively labeled as X21, X22, X2*n*, the polarity of a display signal transmitted in the data bus X11 is the same as the polarity of a display signal transmitted in the data bus X21. Similarly, the polarity of a display signal transmitted in the data bus X12 is the same as the polarity of a display signal transmitted in the data bus X22, and the polarity of a display signal transmitted in the data bus X1*n* is the same as the polarity of a display signal transmitted in the data bus X2*n*.

If polarities of display signals transmitted in the data bus X11 is '+−+−+−', where '+' indicates a display signal with a positive polarity, and '−' indicates a display signal with a negative polarity, polarities of display signals transmitted in the data bus X21 are also '+−+−+−' in sequence. A transition from the positive polarity to the negative polarity is a polarity reversal. Similarly, other data buses are the same as the above data bus. No repeated description is provided herein.

In this way, the multiplexers 12 of different structures correspond to different cycle units 17, and a flexible design may be performed according to requirements, to thereby improve flexibility of the design of the display panel.

In some embodiments of the present disclosure, the ratio of the number of outputting ends OUT of each multiplexer 12 to the number of inputting ends IN is inversely related to the number of data buses 16 included in the cycle unit 17.

That is, the larger the ratio of the number of outputting ends OUT of the multiplexer 12 to the number of inputting ends IN, the smaller the number of data buses 16 included in the cycle unit 17. In one embodiment, the smaller the ratio of the number of outputting ends OUT of the multiplexer 12 to the number of inputting ends IN, the more the number of data buses 16 included in the cycle unit 17.

In one embodiment, referring to the schematic diagram of a corresponding relationship between one type of multiplexer 12 and a cycle unit 17 shown in FIG. 4, each multiplexer 12 includes an inputting end (indicated by IN) and two outputting ends (indicated by OUT). In this case, the ratio of the number of outputting ends OUT to the number of the inputting ends IN is 2. Correspondingly, the number of data buses 16 included in the cycle unit 17 is 12, that is, every adjacent 12 data buses 16 constitute one cycle unit 17 for cycle setting.

Correspondingly, the polarity reversal manner of display signals in the data buses 16 may be shown in Table 1. Table 1 corresponds to a structure as shown in FIG. 4. Only display signals of data buses in one cycle unit 17 are given in Table 1, but this does not indicate that the display panel is only provided with one cycle unit 17. One cycle unit 17 is only used as an example for description here.

In Table 1, the data bus number indicates data buses 16 included in one cycle unit 17, and the polarity reversal manners 1 and 2 each indicate polarities of display signals inputted, in a time sharing manner, by the data buses 16 electrically connected to the inputting ends of the multiplexers 12. '+' indicates a display signal with a positive polarity, and '−' indicates a display signal with a negative polarity.

TABLE 1

| Data bus number | S1 | S2 | S3 | S4 | S5 | S6 | S7 | S8 | S9 | S10 | S11 | S12 |
|---|---|---|---|---|---|---|---|---|---|---|---|---|
| Polarity reversal manner 1 | +− | +− | +− | −+ | −+ | −+ | −+ | −+ | −+ | +− | +− | +− |
| Polarity reversal manner 2 | −+ | +− | ++ | −− | +− | −+ | +− | −+ | −− | ++ | −+ | +− |

Referring to Table 1, it may be learned that the polarities of the display signals inputted by the data buses 16 in a time sharing manner may be the same (such as '++' or '−−'), or may be different (such as '+−' or '−+'). Moreover, the polarity reversal manner of the display signals in the data buses 16 corresponding to the structure shown in FIG. 4 is not limited to that shown in Table 1, and may be other polarity reversal manners, provided that it may be ensured that polarities of display signals of some sub-pixels among the sub-pixels having the same color in at least one row of sub-pixels are different. This is not limited herein.

It shall be noted that, polarities of display signals inputted to two rows of sub-pixels in the broken line box A2 in FIG. 4 are inputted by using the data buses according to the polarity reversal manner 1 in Table 1, and polarities of display signals of remaining rows of sub-pixels are inputted by using the data buses according to the polarity reversal manner of '+−'.

As illustrated in FIG. 5, when each multiplexer 12 includes two inputting ends IN and four outputting ends OUT, the ratio of the number of outputting ends OUT to the number of inputting ends IN is also 2. In this case, the number of data buses 16 included in the cycle unit 17 is still 12, that is, every 12 adjacent data buses 16 constitute one cycle unit 17 for cycle setting.

Correspondingly, the polarity reversal manner of display signals in the data buses 16 may be shown in Table 2. Table 2 corresponds to a structure shown in FIG. 5. In Table 2, the data bus number indicates data buses 16 included in the cycle unit 17, and the polarity reversal manners 1 and 2 each indicates polarities the display signals inputted, in a time-sharing manner, by the data buses 16 electrically connected to the inputting ends of the multiplexers 12.

TABLE 2

| Data bus number | S1 | S2 | S3 | S4 | S5 | S6 | S7 | S8 | S9 | S10 | S11 | S12 |
|---|---|---|---|---|---|---|---|---|---|---|---|---|
| Polarity reversal manner 1 | ++ | −− | +− | −+ | −− | ++ | −− | ++ | −+ | +− | ++ | −− |
| Polarity reversal manner 2 | −+ | +− | +− | +− | +− | −+ | +− | −+ | −+ | −+ | −+ | +− |

Referring to Table 2, the polarities of the display signals inputted by the data buses 16 at different times may be the same, or may be different. Moreover, the polarity reversal manner of the display signals in the data buses 16 corresponding to the structure shown in FIG. 5 is not limited to that shown in Table 2, and may be other polarity reversal manners, provided that it may be ensured that polarities of display signals of some sub-pixels among the sub-pixels having the same color in at least one row of sub-pixels are different. This is not limited herein.

It should be noted that, the polarity of the display signals inputted to the sub-pixels in FIG. 5 are inputted by using the data buses according to the polarity reversal manner 1 in Table 2.

In one embodiment, referring to the schematic diagram of a corresponding relationship between another type of multiplexer 12 and a cycle unit 17 shown in FIG. 6, each multiplexer 12 includes one inputting end IN and three outputting ends OUT. In this case, the ratio of the number of outputting ends OUT to the number of inputting ends IN is 3. Correspondingly, the number of data buses 16 included in the cycle unit 17 is 8, that is, every eight adjacent data buses 16 constitute one cycle unit 17 for cycle setting.

Correspondingly, the polarity reversal manner of display signals in the data buses 16 may be shown in Table 3. Table 3 corresponds to a structure shown in FIG. 6. In Table 3, the data bus number indicates data buses 16 included in the cycle unit 17, and the polarity reversal manners 1 and 2 each indicates polarities of the display signals inputted, in a time-sharing manner, by the data buses 16 electrically connected to the inputting ends of the multiplexers 12.

TABLE 3

| Data bus number | S1 | S2 | S3 | S4 | S5 | S6 | S7 | S8 |
|---|---|---|---|---|---|---|---|---|
| Polarity reversal manner 1 | +−+ | −+− | −+− | +−+ | −+− | +−+ | +−+ | −+− |
| Polarity reversal manner 2 | −++ | −++ | −−+ | −−+ | +−− | +−− | ++− | ++− |

Similarly, in Table 3, the polarities of the display signals inputted by the data buses 16 at different times may be the same or different. Moreover, the polarity reversal manner of the display signals in the data buses 16 corresponding to the structure shown in FIG. 6 is not limited to that shown in Table 3, and may be other polarity reversal manners, provided that it may be ensured that polarities of display signals inputted to some sub-pixels among the sub-pixels having the same color in at least one row of sub-pixels are different. This is not limited herein.

It should be noted that the polarities of the display signals inputted to the sub-pixels in FIG. 6 are inputted by using the data buses according to the polarity reversal manner 1 in Table 3.

As illustrated in FIG. 7, when each multiplexer 12 includes two inputting ends IN and six outputting ends OUT, the ratio of the number of the outputting ends OUT to the number of the inputting ends IN is also 3. In this case, the number of data buses 16 included in the cycle unit 17 is still 8, that is, every eight adjacent data buses 16 constitute one cycle unit 17 for cycle setting.

Correspondingly, the polarity reversal manner of display signals in the data buses 16 may be shown in Table 4. Table 4 corresponds to a structure shown in FIG. 7. In Table 4, the data bus number indicates data buses 16 included in the cycle unit 17, and the polarity reversal manners 1 and 2 each indicates polarities of the display signals inputted, in a time-sharing manner, by the data buses 16 electrically connected to the inputting ends IN of the multiplexers 12.

TABLE 4

| Data bus number | S1 | S2 | S3 | S4 | S5 | S6 | S7 | S8 |
|---|---|---|---|---|---|---|---|---|
| Polarity reversal manner 1 | +++ | −−− | −−− | +++ | −−− | +++ | +++ | −−− |
| Polarity reversal manner 2 | −++ | −++ | −−+ | −−+ | +−− | +−− | ++− | ++− |

Similarly, in Table 4, the polarities of the display signals inputted by the data buses 16 at different times may be the same, or may be different. Moreover, the polarity reversal manner of the display signals in the data buses 16 corresponding to a structure shown in FIG. 7 is not limited to that shown in Table 4, and may be other polarity reversal manners, provided that it may be ensured that polarities of display signals inputted to some sub-pixels among the sub-pixels having the same color in at least one row of sub-pixels are different. This is not limited herein.

It should be noted that the polarities of the display signals inputted to the sub-pixels in FIG. 7 are inputted by the data buses according to the polarity reversal manner 1 in Table 4.

In one embodiment, referring to the schematic diagram of a corresponding relationship between another type of multiplexer 12 and a cycle unit 17 shown in FIG. 8, each multiplexer 12 includes one inputting end IN and six outputting ends OUT. In this case, the ratio of the number of outputting ends OUT to the number of inputting ends IN is 6. Correspondingly, the number of data buses 16 included in the cycle unit 17 is 4, that is, every four adjacent data buses 16 constitute one cycle unit 17 for cycle setting.

Correspondingly, the polarity reversal manner of display signals in the data buses 16 may be shown in Table 5. Table 5 corresponds to a structure shown in FIG. 8. In Table 5, the data bus number indicates data buses 16 included in the cycle unit 17, and the polarity reversal manners 1 and 2 each indicates polarities of the display signals inputted, in a time-sharing manner, by the data buses 16 electrically connected to the inputting ends IN of the multiplexers 12.

TABLE 5

| Data bus number | S1 | S2 | S3 | S4 |
|---|---|---|---|---|
| Polarity reversal manner 1 | +−+−+− | −+−+−+ | −+−+−+ | +−+−+− |
| Polarity reversal manner 2 | −++−++ | −−+−−+ | +−−+−− | ++−++− |

Similarly, in Table 5, the polarities of the display signals inputted by the data buses 16 at different times may be the same, or may be different. Moreover, the polarity reversal manner of the display signals in the data bus 16 corresponding to the structure shown in FIG. 8 is not limited to that shown in Table 5, and may be other polarity reversal, provided that it may be ensured that polarities of display signals inputted to some sub-pixels in sub-pixels having the same color in at least one row of sub-pixels are different. This is not limited herein.

It should be noted that, the polarities of the display signals inputted to the sub-pixels in FIG. 8 are inputted by using the data buses according to the polarity reversal manner 1 in Table 5.

As illustrated in FIG. 9, when each multiplexer 12 includes two inputting ends IN and twelve outputting ends OUT, the ratio of the number of outputting ends OUT to the number of inputting ends IN is also 6. In this case, the number of data buses 16 included in the cycle unit 17 is still 4, that is, every four adjacent data buses 16 constitute one cycle unit 17 for cycle setting.

Correspondingly, the polarity reversal manner of display signals in the data buses 16 may be shown in Table 6. Table 6 corresponds to a structure shown in FIG. 8. In Table 6, the data bus number indicates data buses 16 included in the cycle unit 17, and the polarity reversal manners 1 and 2 each indicate polarities of the display signals inputted, in a time-sharing manner, by the data buses 16 electrically connected to the inputting ends IN of the multiplexers 12.

TABLE 6

| Data bus number | S1 | S2 | S3 | S4 |
|---|---|---|---|---|
| Polarity reversal manner1 | +++−−− | −−−+++ | −−−+++ | +++−−− |
| Polarity reversal manner2 | −++−−+ | −++−−+ | +−−++− | +−−++− |

Similarly, in Table 6, the polarities of display signals inputted by the data buses 16 at different times may be the same, or may be different. Moreover, the polarity reversal manner of the display signals in the data buses 16 corresponding to a structure shown in FIG. 9 is not limited to that shown in Table 6, and may be other polarity reversal manners, provided that it may be ensured that polarities of the display signals inputted to some sub-pixels among the sub-pixels having the same color in at least one row of sub-pixels are different. This is not limited herein.

It should be noted that, the polarities of the display signals inputted to the sub-pixels in FIG. 9 is inputted by using the data buses according to the polarity reversal manner 1 in Table 6.

In a specific implementation, in the embodiment of the present disclosure, there may be various structures of the multiplexers 12. The structure shown in FIG. 4 is used as an example to describe a working process of the multiplexer 12 as follows.

Referring to FIG. 4, the multiplexer 12 includes an inputting end IN, two outputting ends OUT, and two control ends (respectively recorded as CK1 and CK2). The multiplexer 12 may include two transistors that are respectively recorded as a first transistor T1 and a second transistor T2. A gate of the first transistor T1 is electrically connected to the control end CK1, a source of the first transistor T1 is electrically connected to the inputting end IN of the multiplexer 12, and a drain of the first transistor T1 is electrically connected to one outputting end OUT of 12 of the multiplexer 12. A gate of the second transistor T2 is electrically connected to the control end CK2, a source of the second transistor T2 is electrically connected to the inputting end IN of the multiplexer 12, and a drain of the second transistor T2 is electrically connected to the other outputting end OUT of the multiplexer 12.

Thus, the display signals inputted by the inputting ends IN may be outputted, in a time-sharing manner, to the data lines 15 electrically connected to the two outputting ends OUT by using the multiplexer 12 shown in FIG. 4 under the actions of the first transistor T1 and the second transistor T2, and under the control of the two control ends CK1 and CK2, so that transmission of the display signals is implemented.

Similarly, a working process of the multiplexer 12 shown in FIG. 5 to FIG. 9 is similar to the above process. No repeated description is provided.

It should be noted that, in the embodiments of the present disclosure, the structure of the multiplexer 12 is not limited to that shown in FIG. 4 to FIG. 9, which is merely an example for description herein. The structure of the multiplexer 12 may be flexibly designed according to actual needs. This is not specifically limited herein.

Based on the same inventive concept, an embodiment of the present disclosure provides a display panel. As shown in FIG. 3 to FIG. 9, the display panel is driven by the driving method provided by the embodiments of the present disclosure.

Based on the same inventive concept, an embodiment of the present disclosure provides a display device. A structure of the display device shown in FIG. 10 includes the above display panel 10 according to the embodiments of the present disclosure.

Figure 10:
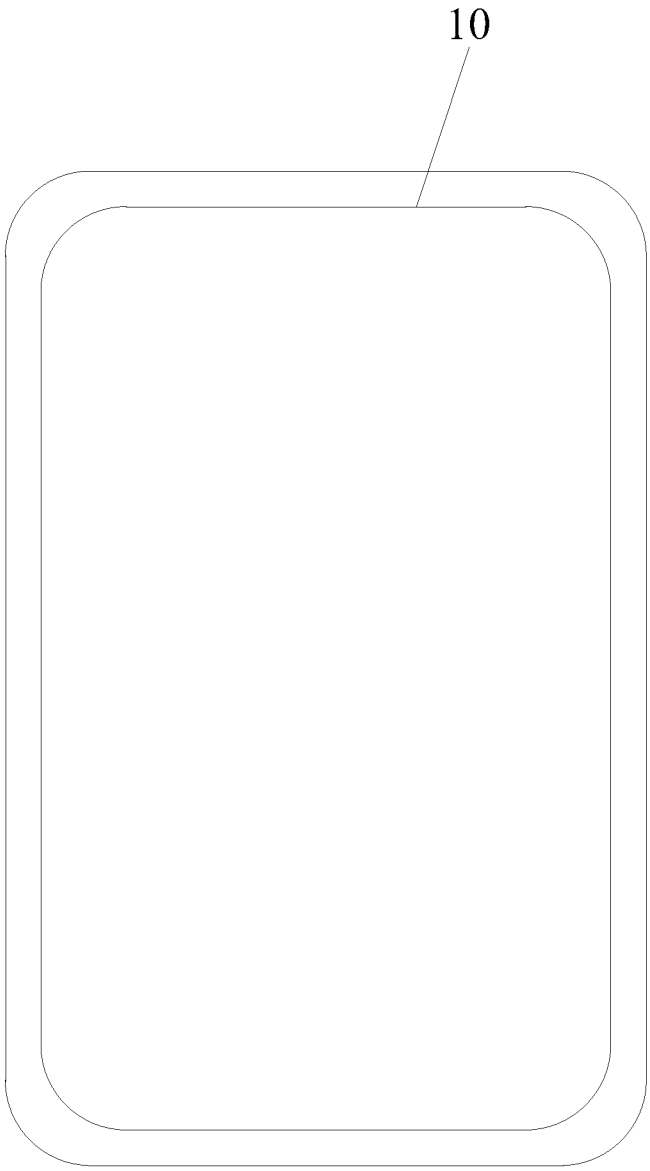
FIG. 10 illustrates a structural schematic diagram of a display device according to an embodiment of the present disclosure.

In a specific implementation, the display device may be any product or component having a display function, such as a mobile phone (as shown in FIG. 10), a tablet computer, a television, a display, a notebook computer, a digital photo frame and a navigator. For the implementation of the display device, reference may be made to the embodiment of the above display panel. No repeated description is provided.

The embodiments of the present disclosure provide the display panel, the method for driving the display panel, and the display device, in at least one row of the sub-pixels, polarities of display signals inputted to some sub-pixels among the sub-pixels having the same color are different, cross-talk and flicker in a horizontal direction that are brought when polarities of display signals inputted to sub-pixels having the same color are the same may be cancelled out, so that the display effect of the display panel is improved.

What is claimed is:

1. A display panel, comprising:

a display area, comprising a plurality of pixels arranged in an array, wherein each pixel comprises a plurality of sub-pixels, and at least some sub-pixels among the plurality of sub-pixels included in each pixel have different colors;

wherein in some rows of sub-pixels of all rows of sub-pixels, polarities of display signals inputted to some sub-pixels among sub-pixels having the same color are different, and in each of the remaining rows of sub-pixels of the all rows of sub-pixels, a polarity of a display signal inputted to each of sub-pixels having the same color are is same;

wherein each pixel comprises one red sub-pixel, two green sub-pixels and one blue sub-pixel.

2. The display panel according to claim 1, wherein for the sub-pixel row in which the polarities of the display signals inputted to some sub-pixels among the sub-pixels having the same color are different: the sub-pixels having the same color comprise first sub-pixels and second sub-pixels, a display signal having a positive polarity is inputted to the first sub-pixels, a display signal having a negative polarity is inputted to the second sub-pixels, and a quantity of the first sub-pixels is equal to a quantity of the second sub-pixels.

3. The display panel according to claim 1, wherein for the sub-pixel row in which the polarities of the display signals inputted to some sub-pixels among the sub-pixels having the same color are different: polarities of display signals inputted to some two adjacent sub-pixels are the same, and polarities of display signals inputted to remaining two adjacent sub-pixels are different.

4. The display panel according to claim 1, wherein the display panel further comprises:

a plurality of data lines, wherein one column of sub-pixels is disposed between any two adjacent data lines, sub-pixels located in an odd row are electrically connected to an adjacent data line on the right side, and sub-pixels located in an even row are electrically connected to an adjacent data line on the left side.

5. The display panel according to claim 4, wherein polarities of display signals inputted to at least some two adjacent data lines are opposite.

6. The display panel according to claim 1, wherein the display panel further comprises:

a plurality of data lines; and a frame area surrounding the display area;

wherein the plurality of data lines are electrically connected to the sub-pixels;

the frame area comprises multiplexers and data buses, outputting ends of the multiplexers are electrically connected to the plurality of data lines, and inputting ends of the multiplexers are electrically connected to the data buses; and the multiplexers are configured to input, in a time-sharing manner, display signals inputted by the data buses, to the plurality of data lines that are correspondingly connected with the multiplexers, and input the display signals to the sub-pixels via the data lines, to enable the polarities of the display signals inputted to some sub-pixels among the sub-pixels having the same color in the at least one row of the plurality of sub-pixels, to be different.

7. The display panel according to claim 6, wherein when the display panel comprises a first multiplexer with a first structure, a ratio of a quantity of outputting ends of to a quantity of inputting ends of a the first multiplexer is a first ratio;

when the display panel comprises a second multiplexer with any other structure different from the first structure, a ratio of a quantity of outputting ends of to a quantity of inputting ends of a the second multiplexer is a second ratio;

the first ratio is different from the second ratio, and a quantity of data buses included in a first cycle unit corresponding to the first multiplexer is different from a quantity of data buses included in a second cycle unit corresponding to the second multiplexer, the first multiplexer and the second multiplexer are any two of the multiplexers; and each cycle unit comprises a plurality of data buses, and polarity reversal manners of display signals in the data buses in different cycle units are the same.

8. The display panel according to claim 7, wherein the first ratio or the second ratio is inversely related to the a quantity of data buses included in a cycle unit corresponding to the each multiplexer.

9. The display panel according to claim 8, wherein the first ratio or the second ratio is 2, and the quantity of data buses included in the cycle unit is 12; or the first ratio or the second ratio is 3, and the quantity of data buses included in the cycle unit is 8; or the first ratio or the second ratio is 6, and the quantity of data buses included in the cycle unit is 4.

10. The display panel according to claim 1, wherein each pixel comprises four sub-pixels.

11. A method for driving a display panel, wherein the display panel comprises a display area, the display area comprises a plurality of pixels arranged in an array, each pixel comprises a plurality of sub-pixels, and at least some sub-pixels among the plurality of sub-pixels included in each pixel have different colors; and the method comprises:

driving, polarities of display signals inputted to some sub-pixels among sub-pixels having the same color in some rows of sub-pixels of all rows of sub-pixels, to be different; and driving, a polarity of a display signal inputted to each of sub-pixels having the same color in each of the remaining rows of sub-pixels of the all rows of sub-pixels, to be same;

wherein each pixel comprises one red sub-pixel, two green sub-pixels and one blue sub-pixel.

12. The method according to claim 11, wherein the method further comprises:

driving, polarities of display signals inputted to some sub-pixels among the sub-pixels having the same color in any row of the plurality of sub-pixels, to be different.

13. The method according to claim 11, wherein the display panel comprises a plurality of data lines and a frame area surrounding the display area, the plurality of data lines are electrically connected to the sub-pixels, the frame area comprises multiplexers and data buses, outputting ends of the multiplexers are electrically connected to the plurality of data lines, and inputting ends of the multiplexers are electrically connected to the data buses; and the method further comprises:

inputting, by the multiplexers in a time-sharing manner, display signals inputted by the data buses, to the plurality of data lines that are correspondingly connected with the multiplexers; and inputting the display signals to the sub-pixels via the data lines, to enable the polarities of the display signals inputted to some sub-pixels among the sub-pixels having the same color in the at least one row of the plurality of sub-pixels, to be different.

14. A display device, comprising:

a display panel comprising a display area, wherein the display area comprises a plurality of pixels arranged in an array, each pixel comprises a plurality of sub-pixels, and at least some sub-pixels among the plurality of sub-pixels included in each pixel have different colors;

wherein in some rows of sub-pixels of all rows of sub-pixels, polarities of display signals inputted to some sub-pixels among sub-pixels having the same color are different, and in each of the remaining rows of sub-pixels of the all rows of sub-pixels, a polarity of a display signal inputted to each of sub-pixels having the same color are is same;

wherein each pixel comprises one red sub-pixel, two green sub-pixels and one blue sub-pixel.

* * * * *